US009555305B1

(12) United States Patent
Kellerman et al.

(10) Patent No.: US 9,555,305 B1
(45) Date of Patent: Jan. 31, 2017

(54) GOLF TRAINING AID

(71) Applicants: Deon Kellerman, Montgomery, TX (US); Troy Wolf, Green Bay, WI (US)

(72) Inventors: Deon Kellerman, Montgomery, TX (US); Troy Wolf, Green Bay, WI (US)

( * ) Notice: Subject to any disclaimer, the term of this patent is extended or adjusted under 35 U.S.C. 154(b) by 0 days.

(21) Appl. No.: 15/000,480

(22) Filed: Jan. 19, 2016

(51) Int. Cl.
*A63B 69/36* (2006.01)

(52) U.S. Cl.
CPC ..... *A63B 69/3644* (2013.01); *A63B 2209/02* (2013.01); *A63B 2210/50* (2013.01)

(58) Field of Classification Search
USPC ..... 473/219, 221, 229, 257, 258, 259, 261,473/409
See application file for complete search history.

(56) References Cited

U.S. PATENT DOCUMENTS 2,653,025 A * 9/1953 Zega ..... A63B 69/3644 16/97
3,489,416 A * 1/1970 Mark ..... A63B 69/3644 473/229
3,730,531 A * 5/1973 Zega ..... A63B 69/3644 473/259
5,595,545 A * 1/1997 O'Brien ..... A63B 69/3644 473/259
2010/0151958 A1* 6/2010 Jones ..... A63B 69/3641 473/229

* cited by examiner

*Primary Examiner* — Nini Legesse
(74) *Attorney, Agent, or Firm* — Blake Vande Garde

(57) ABSTRACT

A golf swing training aid comprising a base member, a primary support member emanating upward from the base member, a primary guide rail secured to the primary support member, a backswing guide rail secured to the primary guide rail in the form of an elongate, curved rail which guides a golf club shaft during a golfer's backswing, a swing transition aid secured to a downswing guide rail which operates to guide the club from the top of a golfer's backswing to the beginning of a downswing, the downswing guide rail secured to the primary guide rail in the form of an elongate, curved rail which guides a golf club to a golfer's ball-striking position and a follow-through guide means secured to the primary guide rail in the form of an elongate, curved rail which facilitates the guiding of a golf club shaft to the completion of the golf swing.

19 Claims, 14 Drawing Sheets

GOLF TRAINING AID

FIELD OF INVENTION

The present invention relates to the field of golf swing training devices which aid a golfer in learning proper swing technique and their use.

BACKGROUND OF THE INVENTION

The game of golf is centuries old and is popular the world over. Golf is also one of the most difficult games to master which has spurred development of numerous devices to assist golfers with their training. Devices range from those designed to be worn by the player in order to strengthen muscles or limit movement to those specifically geared toward proper swing technique. Devices which aid in teaching golfers proper technique vary from one to the next. Some devices use ropes and pulleys to train a golfer's swing while others attach weights and bands to teach muscle memory.

The most important task in learning the game of golf is for a golfer to develop muscle memory and consistency in how they swing a golf club. Additionally, learning the proper club swing path as well as knowing the feel of a proper golf swing are keys to success on the course.

Hence, there is clearly a need for a simple device which assists a golfer in learning a proper swing path, the feel of a proper swing and develops consistency in swing execution.

SUMMARY OF THE INVENTION

A golf swing training aid comprising a base member, a primary support member emanating upward from the base member, a primary guide rail secured to the primary support member, a backswing guide rail secured to the primary guide rail in the form of an elongate, curved rail which guides a golf club shaft during a golfer's backswing, a swing transition aid secured to a downswing guide rail which operates to guide the club from the top of a golfer's backswing to the beginning of a downswing, the downswing guide rail secured to the primary guide rail in the form of an elongate, curved rail which guides a golf club to a golfer's ball-striking position and a follow-through guide means secured to the primary guide rail in the form of an elongate, curved rail which facilitates the guiding of a golf club shaft to the completion of the golf swing.

DETAILED DESCRIPTION OF THE INVENTION

Figure 1:
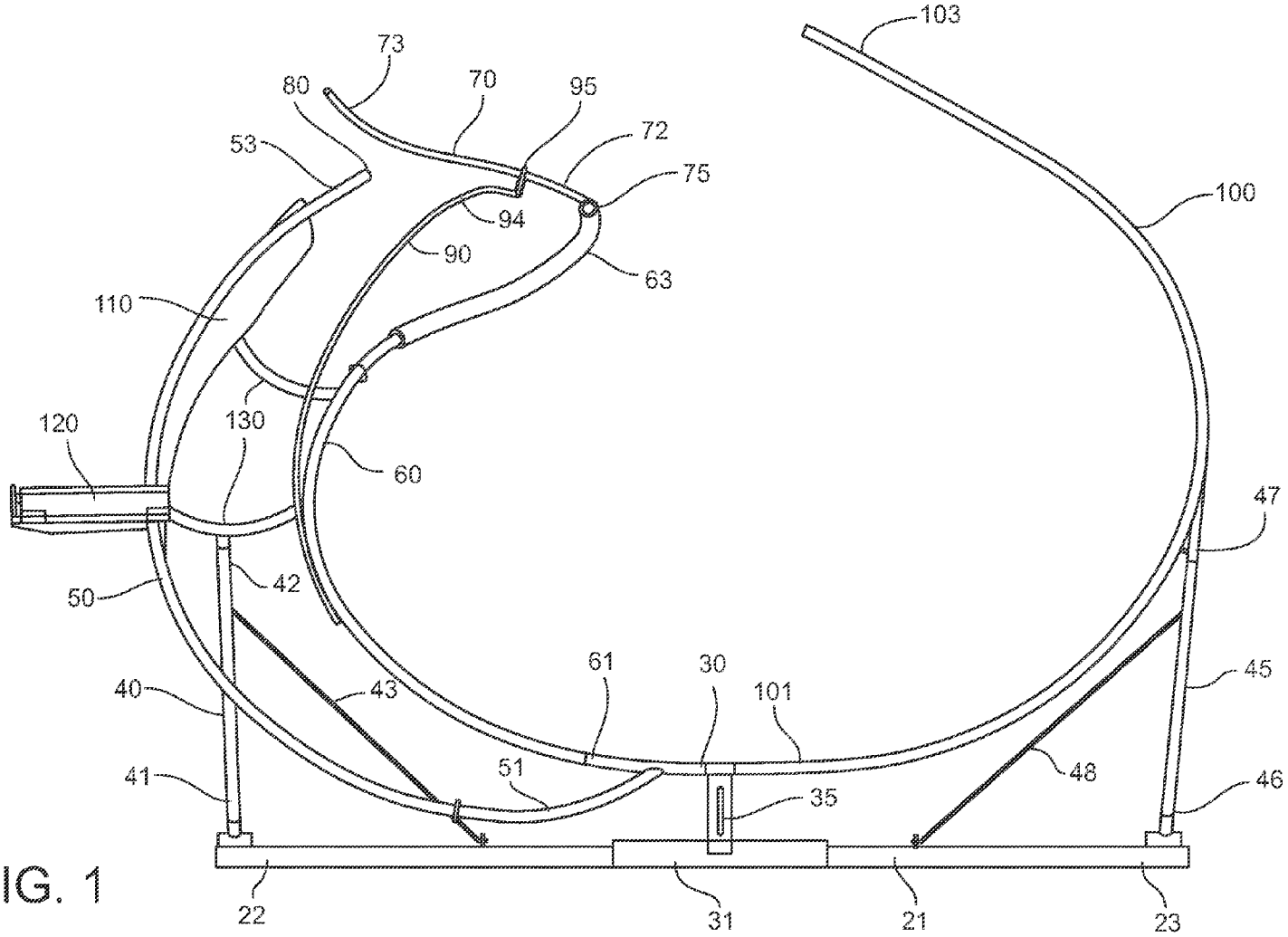
FIG. 1 illustrates a front view of one embodiment of the present invention.
Figure 3:
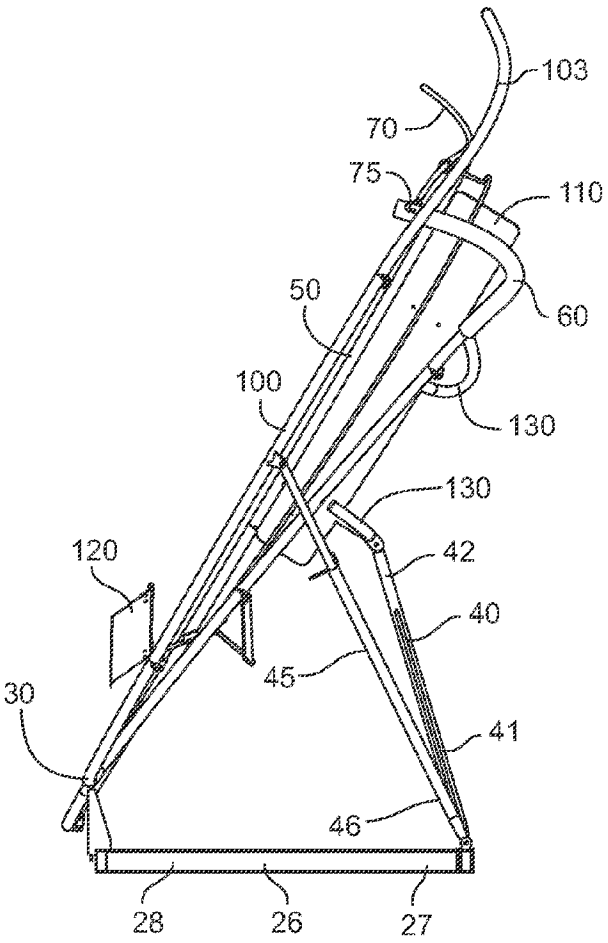
FIG. 3 illustrates a side view of one embodiment of the present invention.
Figure 2:
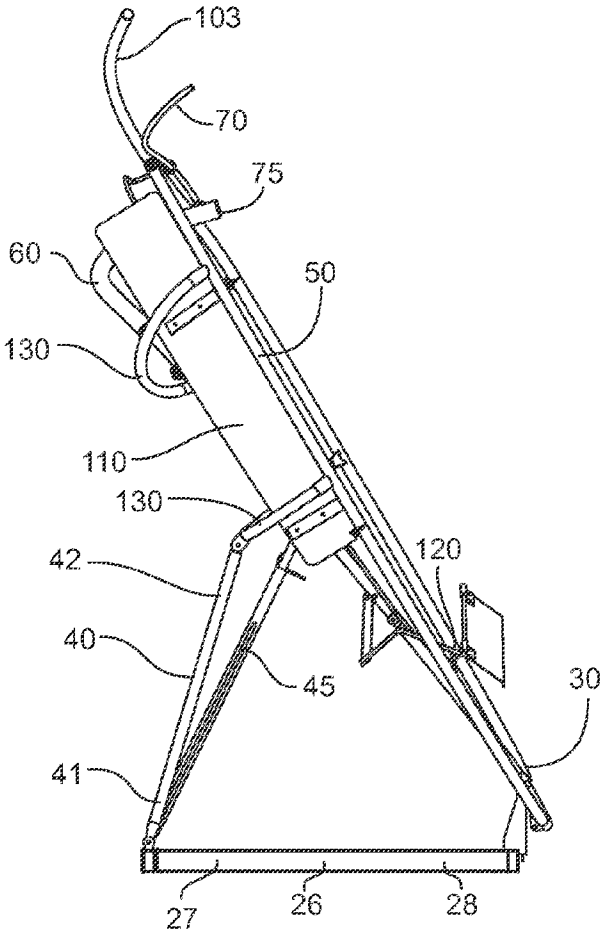
FIG. 2 illustrates a side view of one embodiment of the present invention.

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The instant invention describes a portable golf swing training aid 10 comprising a base 20 including a primary base member 21, a secondary base member 26 secured to the primary base member 21 and a tertiary base member 31 secured to the secondary base member 26. The training aid 10 also includes a primary support member 35 emanating upward from the tertiary base member 31 and a primary guide rail 30 secured to the primary support member 35. A backswing guide rail 50 is secured to the primary guide rail 30 in the form of an elongate, curved rail which facilitates the guiding of a golf club shaft 146 along a desired first angle and arc path from a golfer's address position to the top of a golfer's backswing. A swing transition aid is secured to a downswing guide rail 60, the swing transition aid includes a spring transition gate 70 hingedly secured to the downswing guide rail 60, a resistance member 90 secured at one end to the downswing guide rail 60 and operationally associated with the spring transition gate 70 at an opposite end and an over the top button 80 hingedly secured to the backswing guide rail 50, wherein the swing transition aid operates to guide the golf club 145 from the top of a golfer's backswing when the golf club 145 is at the first angle to a second angle which is less steep than the first angle and the beginning of a downswing. The downswing guide rail 60 is secured to the primary guide rail 30 in the form of an elongate, curved rail which facilitates the guiding of a golf club 145 along the desired second angle and arc path from the top of a golfer's backswing to a golfer's ball-striking position. A proximal support member 40 secured at one end to the base 20 and secured at an opposite end to the backswing guide rail 50, a follow-through guide rail 100 is secured to the primary guide rail 30 in the form of an elongate, curved rail which facilitates the guiding of a golf club shaft 146 along a third angle and arc path after reaching the golfer's ball-striking position and completing the golf swing and a distal support member 45 secured at one end to the base 20 and secured at an opposite end to the follow-through guide rail 100.

Figure 14:
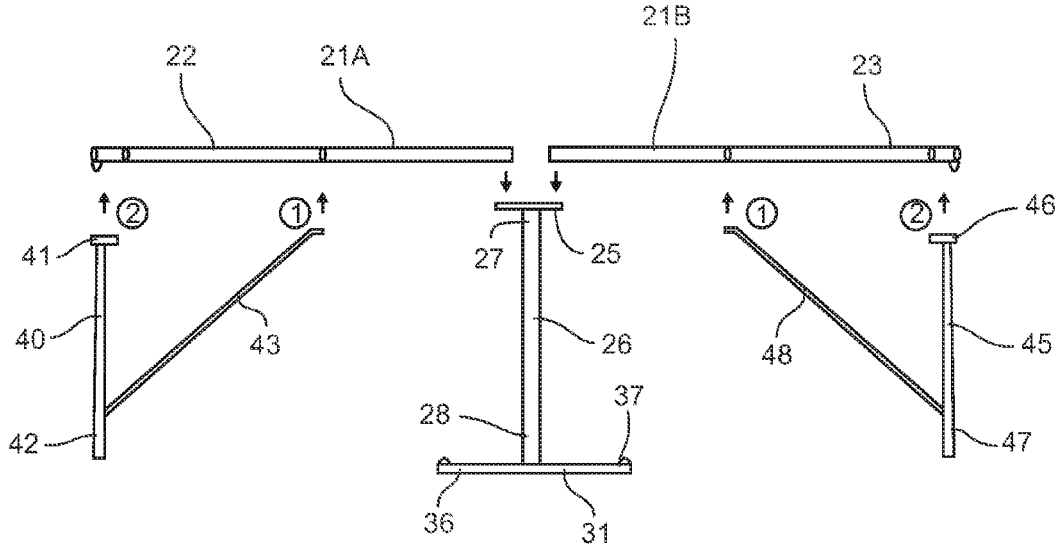
FIG. 14 illustrates an exploded view of one embodiment of a base of the present invention.
Figure 15:
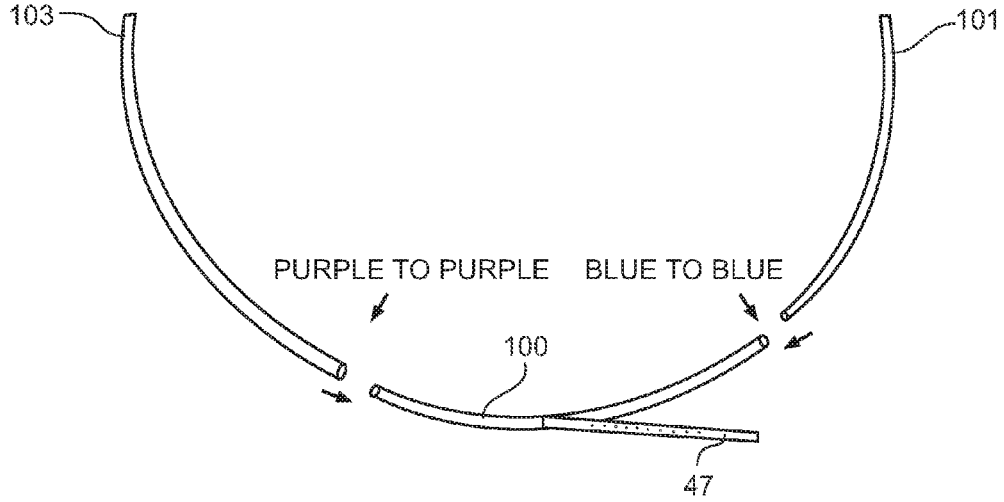
FIG. 15 illustrates an exploded view of one embodiment of a follow-through guide rail of the present invention.
Figure 16:
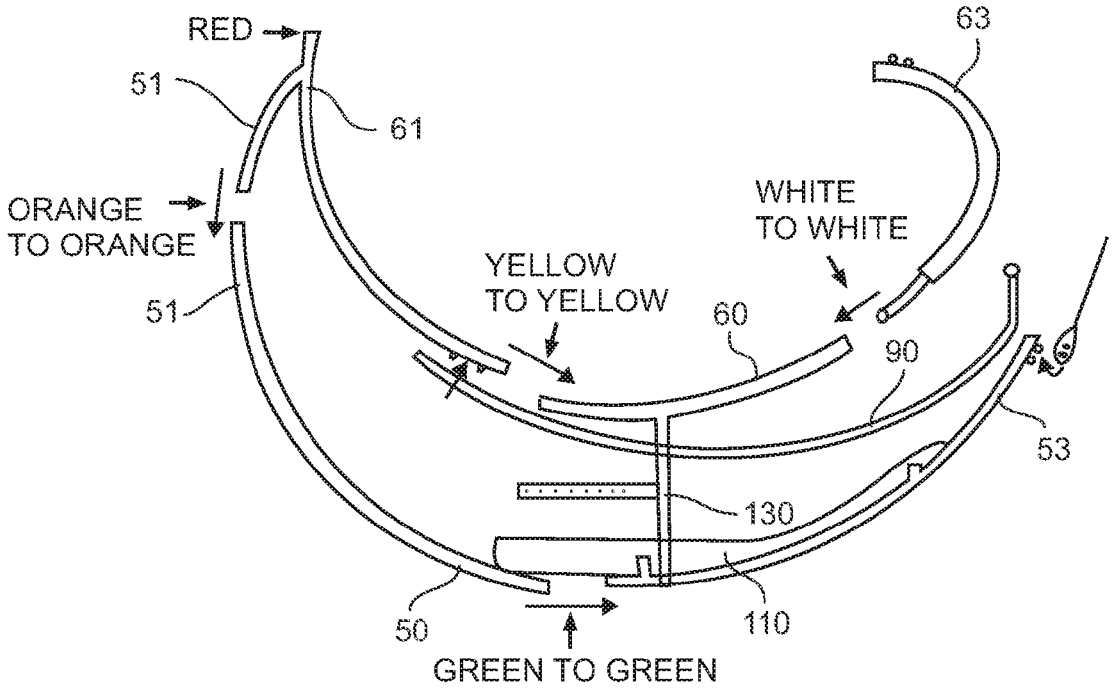
FIG. 16 illustrates an exploded view of one embodiment of a backswing guide rail, a downswing guide rail and other components of the present invention.
Figure 17:
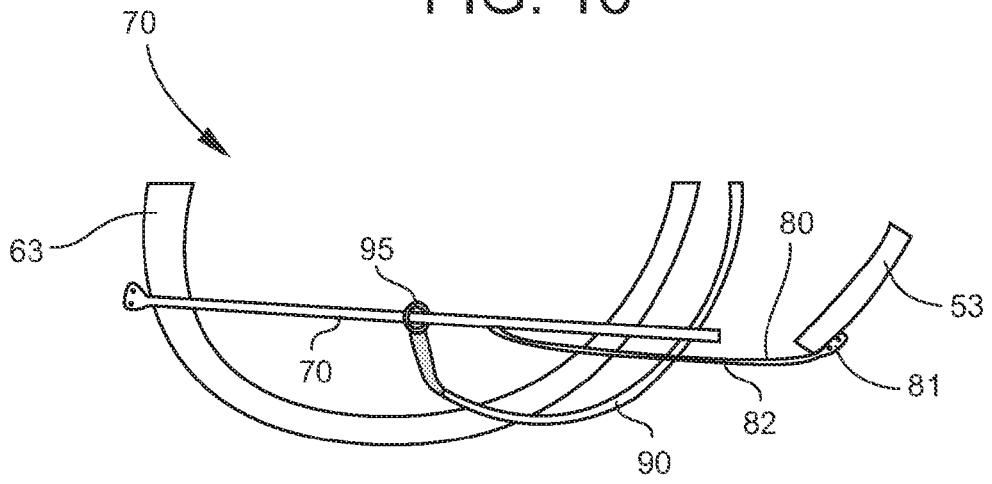
FIG. 17 illustrates a close-up proximal view of a swing transition zone of the present invention.
Figure 18:
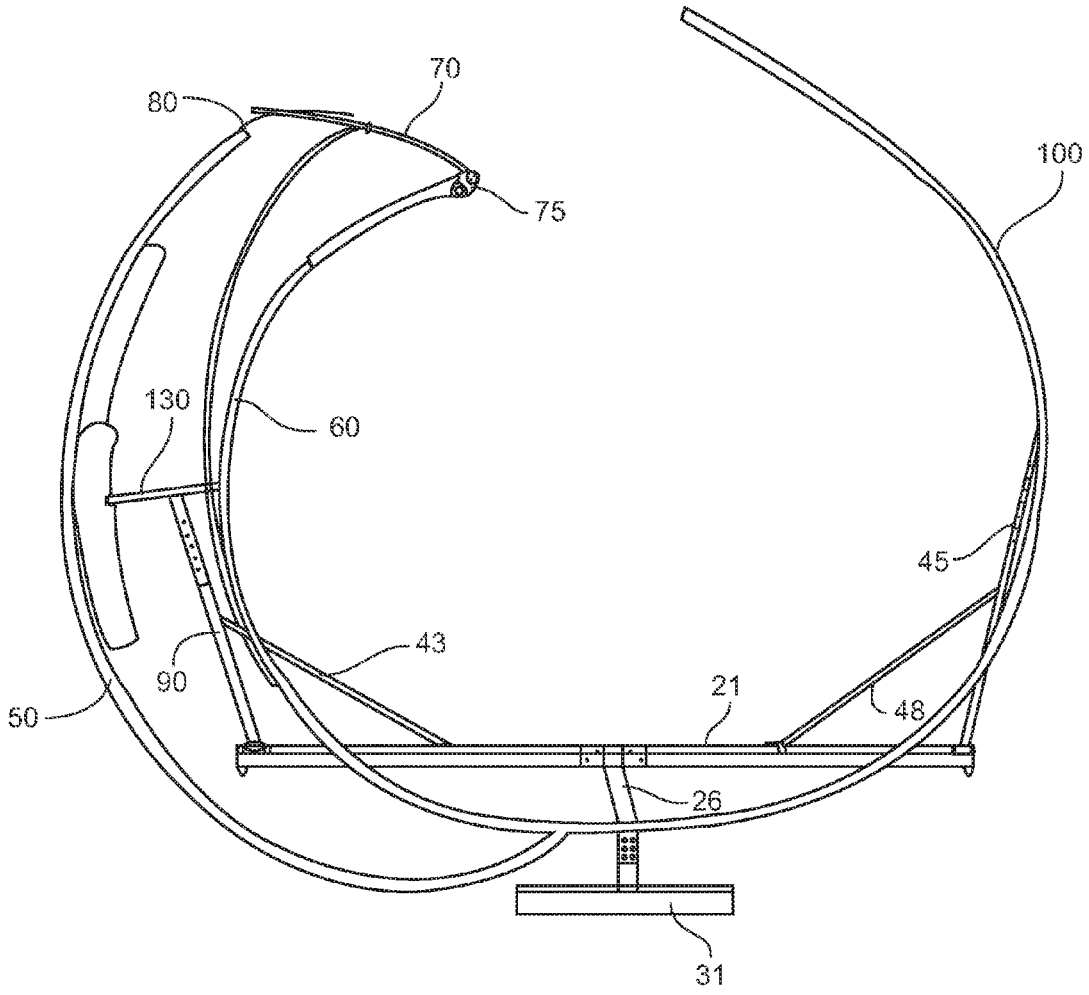
FIG. 18 illustrates a proximal front view of one embodiment of the present invention.

Looking to the figures, there is illustrated an embodiment which includes a base 20 comprising a primary base member 21 with a proximal end 22 and a distal end 23, a secondary base member 26 with a proximal end 27 and a distal end 28 and a tertiary base member 31 with a proximal end 32 and a distal end 33. In one embodiment of the instant invention, the base 20 includes a primary base member 21 which is comprised of a proximal base member 21A and a distal base member 21B as illustrated in FIGS. 14 through 18. The embodiment further includes at t-bar 25 to which the proximal base member 21A and a distal base member 21B are secured. The t-bar 25 is located at the proximal end 27 of the secondary base member 26. The base 20 is specifically designed to simplify assembly and disassembly and to minimize the weight of the swing training aid 10 while still maintaining the stability of the training aid during use. In another embodiment, the base 20 may further include one or more tab extensions 34 emanating laterally from various points on the primary 21, secondary 26 and tertiary 31 base members. The tab extensions 34 may be used to anchor the swing training aid 10 in place through the use of stakes, straps or any other means known in the art (not illustrated).

The vertical parts of the training aid 10 are secured to the base 20 at three points being the primary support member 35, the proximal support member 40 and the distal support member 45. Looking again to the figures, there is illustrated a primary support member 35 with a proximal end 36 and a distal end 37. The primary support member 35 is secured to and emanates up from the distal end 28 of the secondary base member and/or the tertiary base member 31. The proximal support member 40 has a proximal end 41 and a distal end 42. The proximal support member 40 is secured at its proximal end 41 to the proximal end 22 of the primary base member 21 and secured at its distal end 42 to a backswing guide rail 50, a downswing guide rail 60, a brace member 130, or a combination thereof. The distal support member 45 has a proximal end 46 and a distal end 47. The distal support member 45 is secured at its proximal end 46 to the distal end 23 of the primary base member 21 and secured at its distal end 47 to a follow-through guide rail 100. In one embodiment of the instant invention, both the proximal support member 41 and the distal support member 45 are hingedly and releasably secured at their proximal ends 41, 46 respectively to the primary base member 21. In another embodiment, the proximal support member 40 is hingedly and releasably secured at its distal end 42 to a backswing guide rail 50, a downswing guide rail 60, a brace member 130, or a combination thereof and the distal support member 45 is hingedly and releasably secured at its distal end 47 to a follow-through guide rail 100. The proximal support member 40 may be further stabilized with a support rod 43 which is secured at one end to the proximal support member 40 and secured at its opposite and to a primary base member 21. The distal support member 45 may be further stabilized with a support rod 48 which is secured at one end to the distal support member 45 and secured at its opposite and to a primary base member 21. The support rods 43, 48 may be either permanently or releasably secured to the proximal support member 40 in the distal support member 45 respectively. The support members (35, 40, 45) are each individually adjustable (see the chart below). The support members may be adjusted into numerous configurations to accommodate a golfer's height, weight, swing style, swing angles, injuries and a variety of other factors. The support members may be independently telescopic, flexible, rigid, pivoting, hinged or a combination thereof. The length/height of each support member (35, 40, 45) may be retained in a desired position by any means known in the art including, but not limited to, screws, nuts and bolts, cotter pins, lag screws, compression fittings, rods, compression sleeves, clamps, or a combination thereof.

Looking again to the figures, there is illustrated a primary guide rail 30 secured to the distal end 37 of the primary support member 35. A backswing guide rail 50 having a proximal end 51 and a distal end 53, in the form of an elongate, curved rail which facilitates the guiding of a golf club shaft 146 along a desired first angle and arc path from a golfer's address position, through and during a golfer's backswing and to the top of a golfer's backswing. As shown in the figures, the proximal end 51 of the backswing guide rail 50 is secured to the primary support member 35 and the distal end 53 of the backswing guide rail 50 extends at an angle above and behind the address area 142 where the golfer 140 stands to address the golf ball 150. In one embodiment of the instant invention, the backswing guide rail 50 is comprised of two or more pieces which are secured to one another using one or more fasteners. Fasteners may include, but are not limited to, screws, nuts and bolts, cotter pins, lag screws, compression fittings, compression sleeves, clamps, or a combination thereof.

Figure 4:
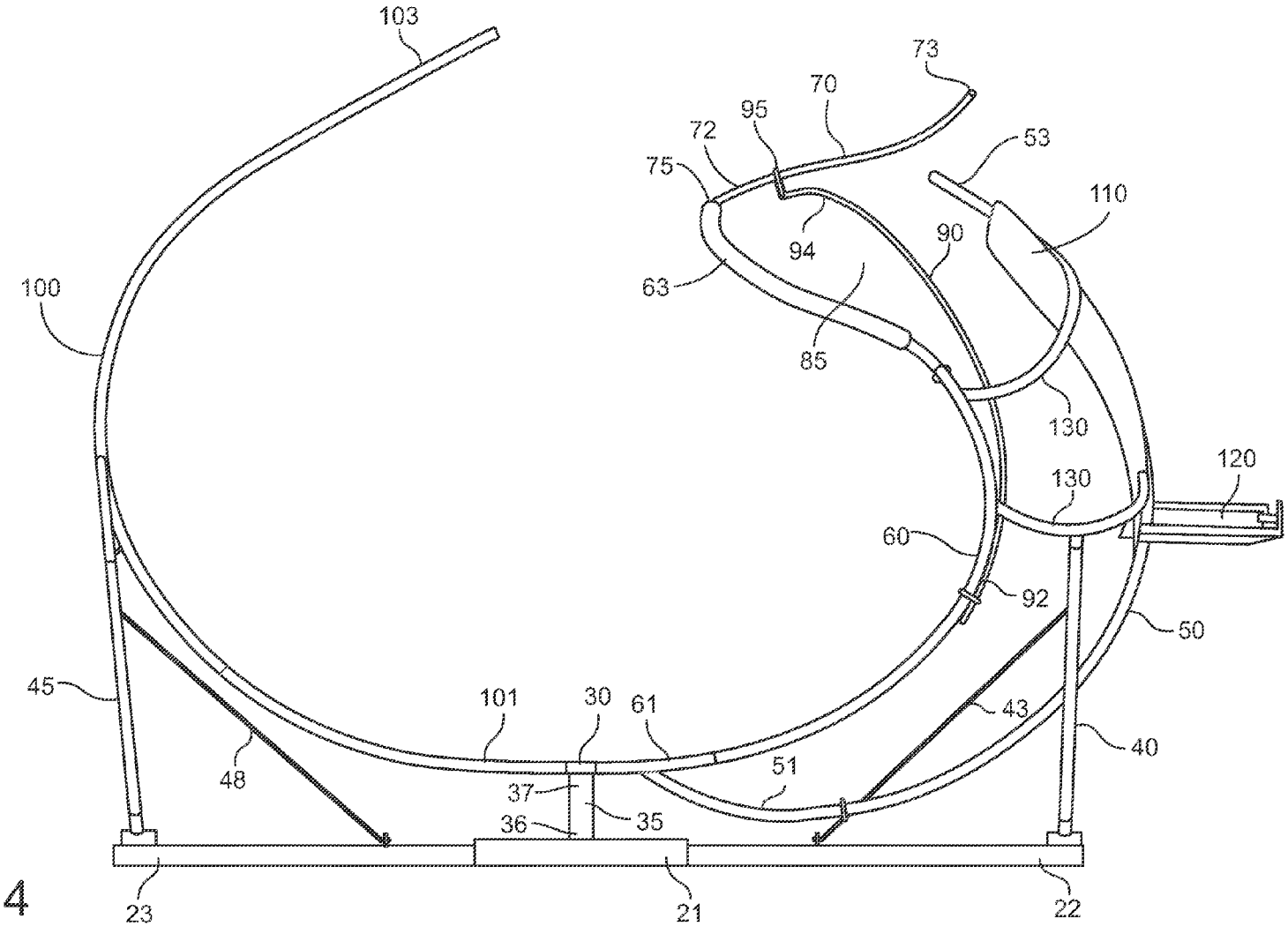
FIG. 4 illustrates a rear view of one embodiment of the present invention.
Figure 5:
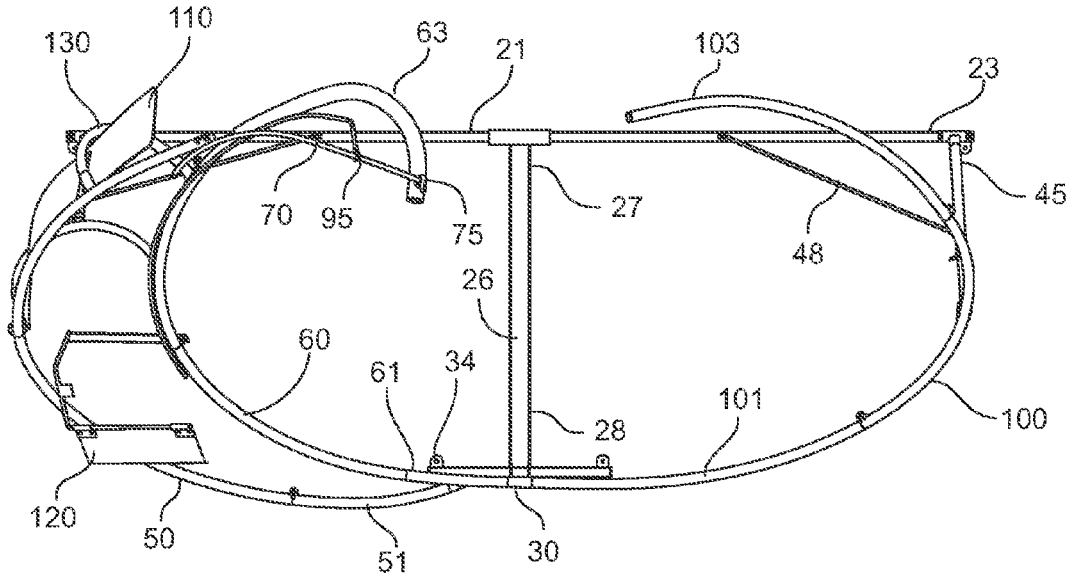
FIG. 5 illustrates a top-down view of one embodiment of the present invention.
Figure 6:
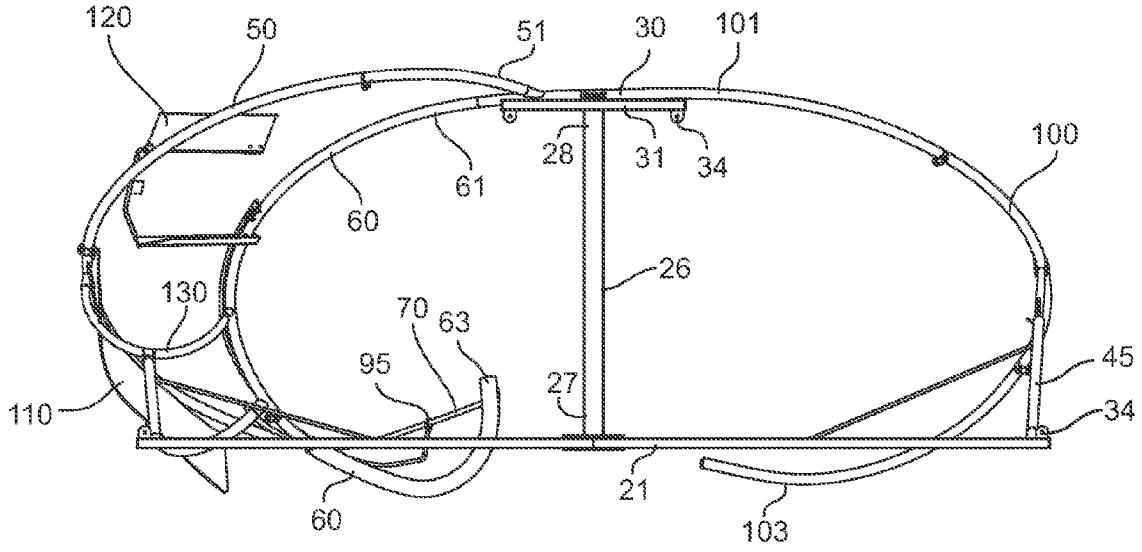
FIG. 6 illustrates a bottom-up view of one embodiment of the present invention.
Figure 7:
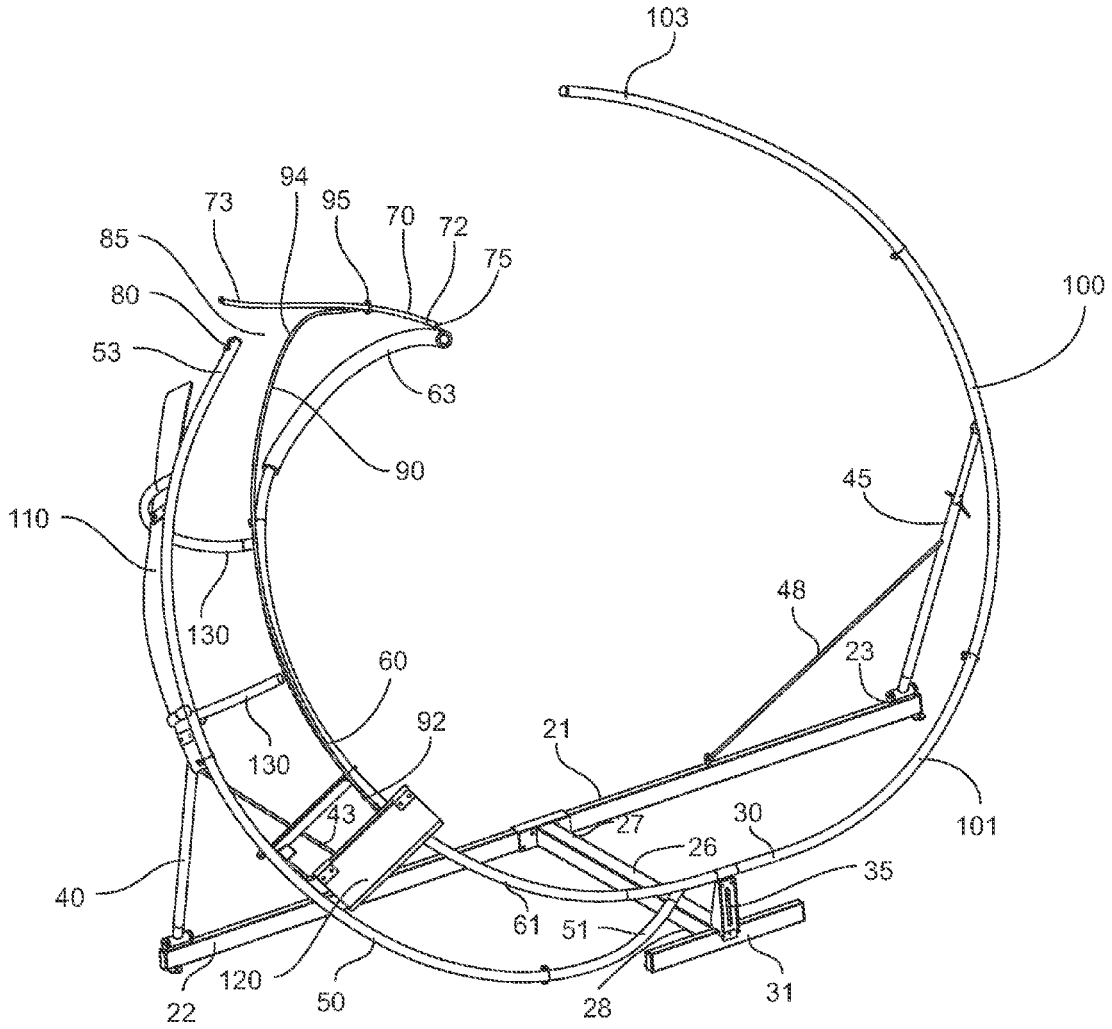
FIG. 7 illustrates a perspective view of one embodiment of the present invention.
Figure 8:
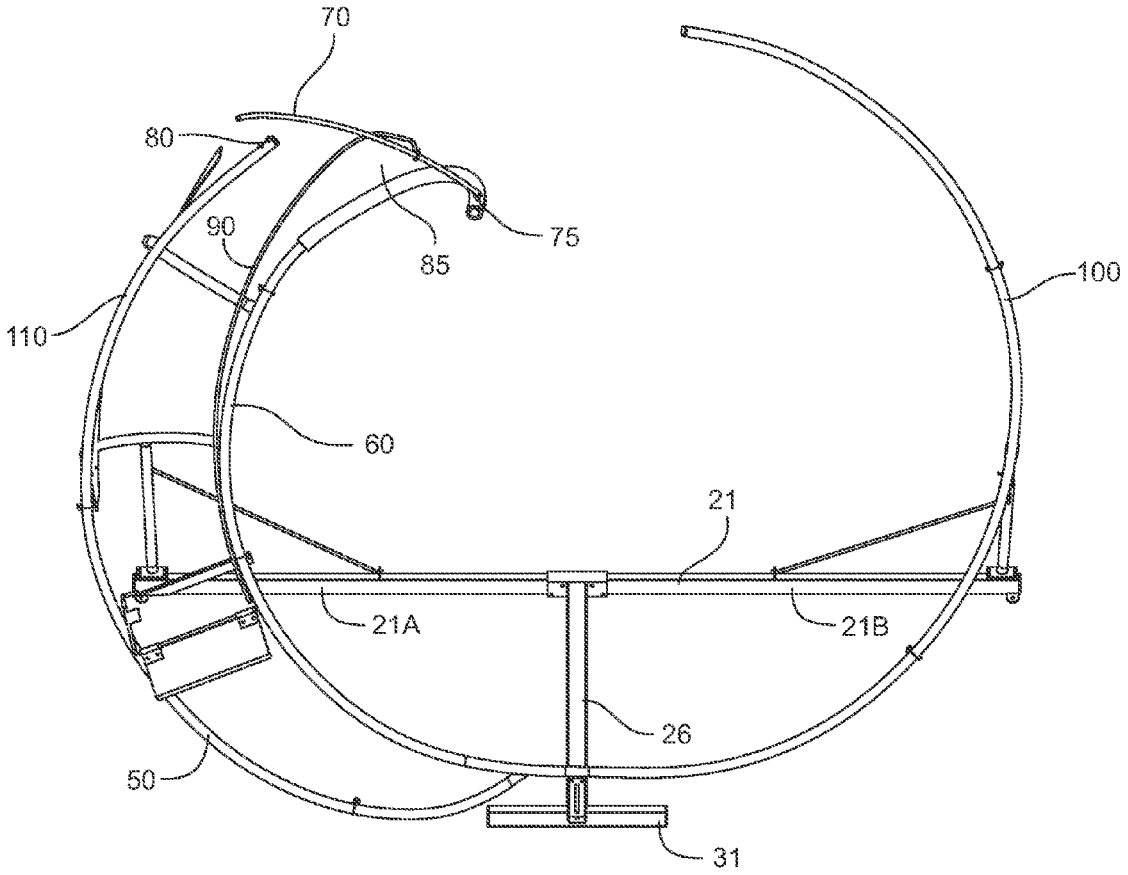
FIG. 8 illustrates a perspective view of one embodiment of the present invention.
Figure 9:
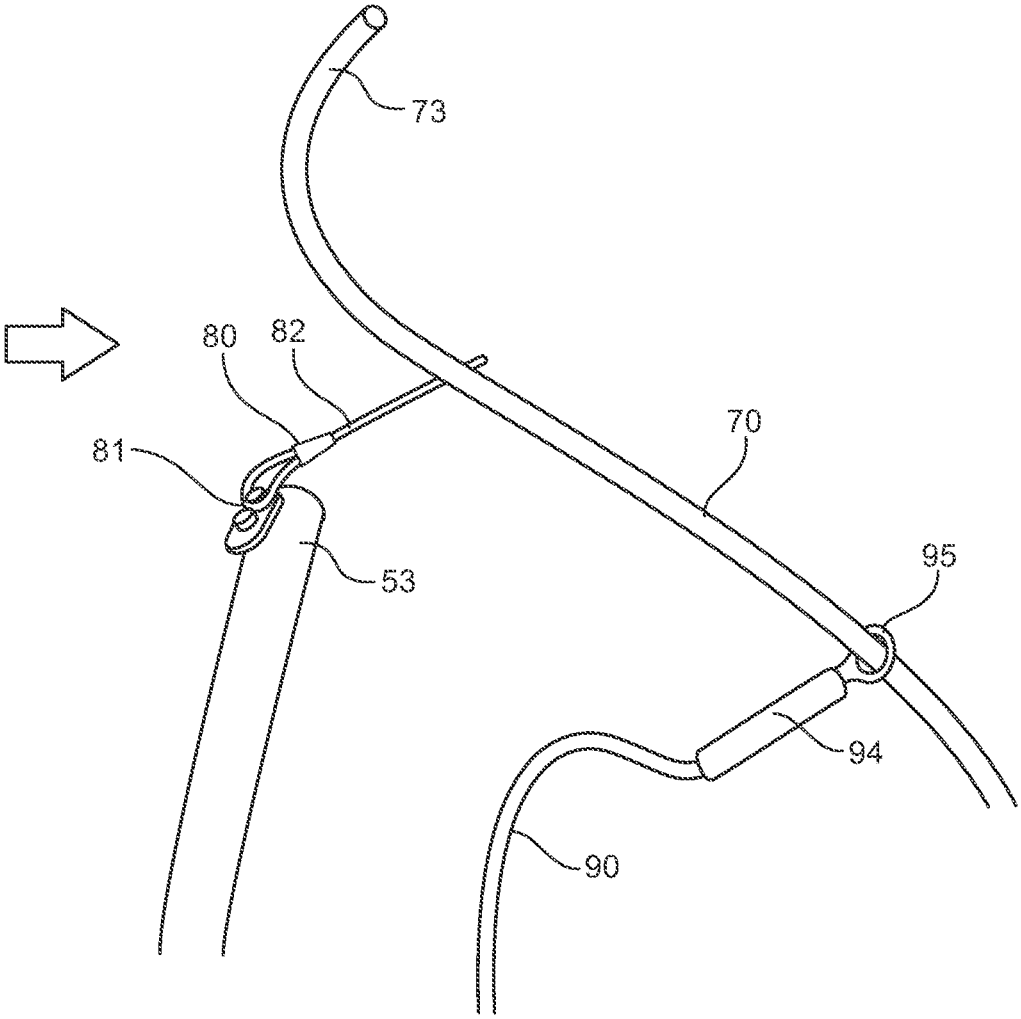
FIG. 9 illustrates a zoom-in view of one element of the present invention.
Figure 10:
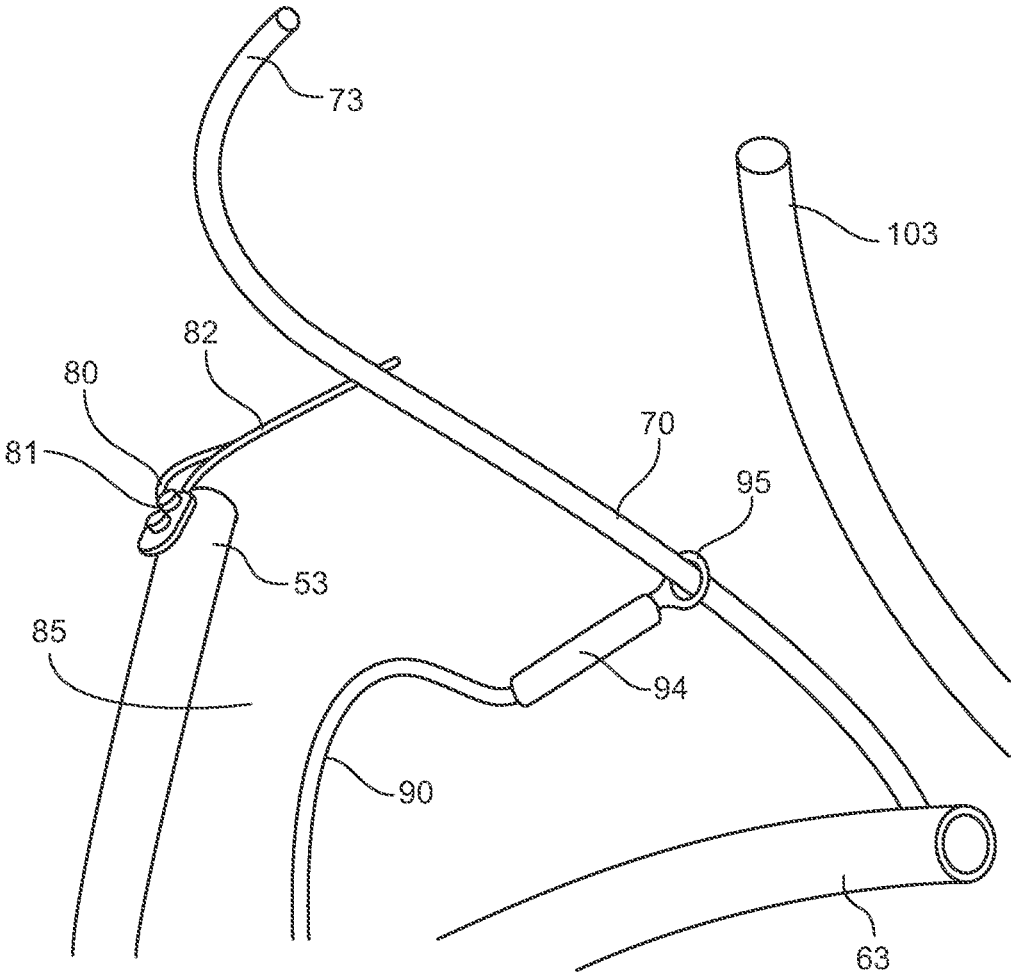
FIG. 10 illustrates a zoom-in view of one element of the present invention.
Figure 11:
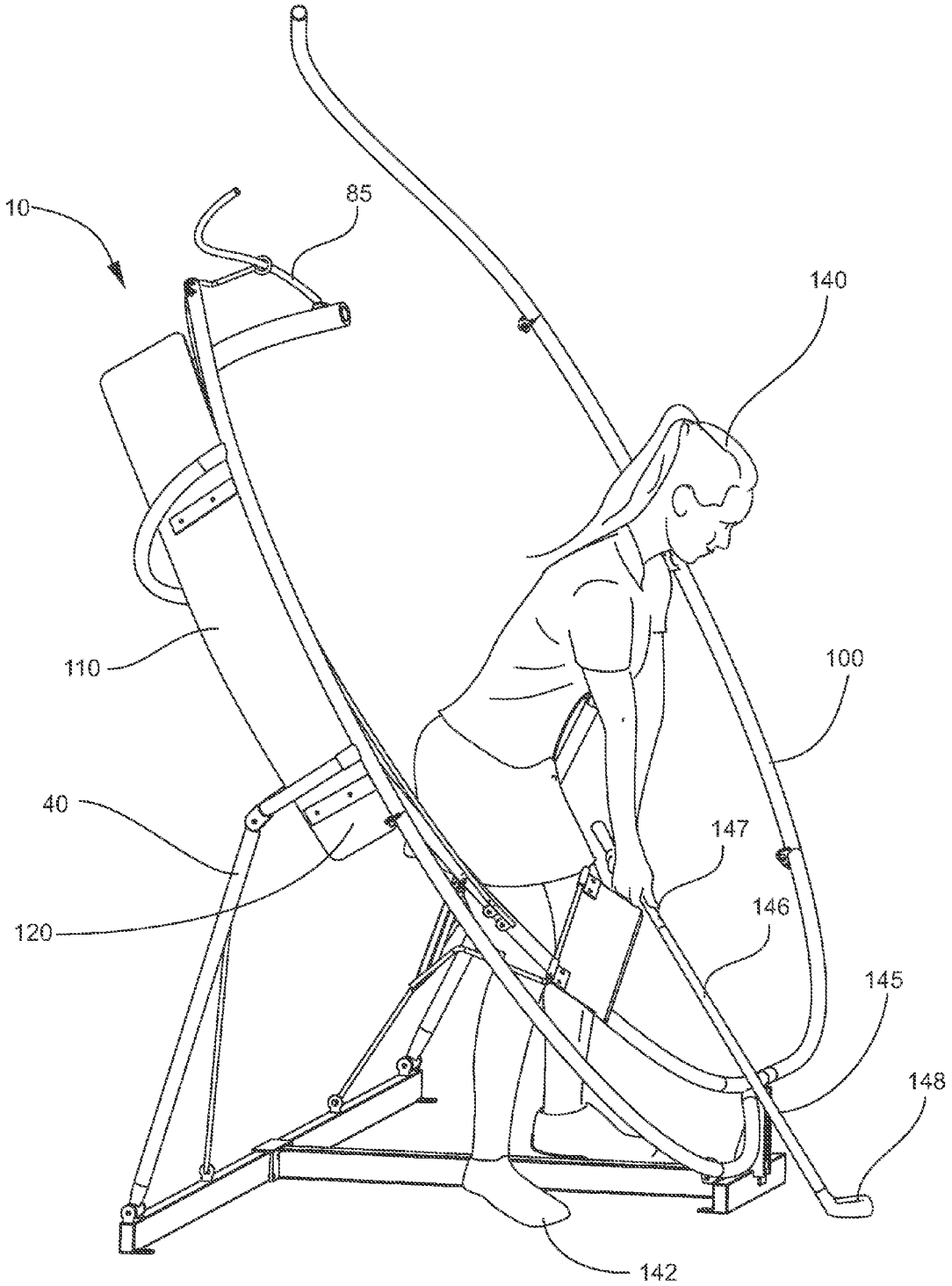
FIG. 11 illustrates a perspective view of one embodiment of the present invention in use.
Figure 12:
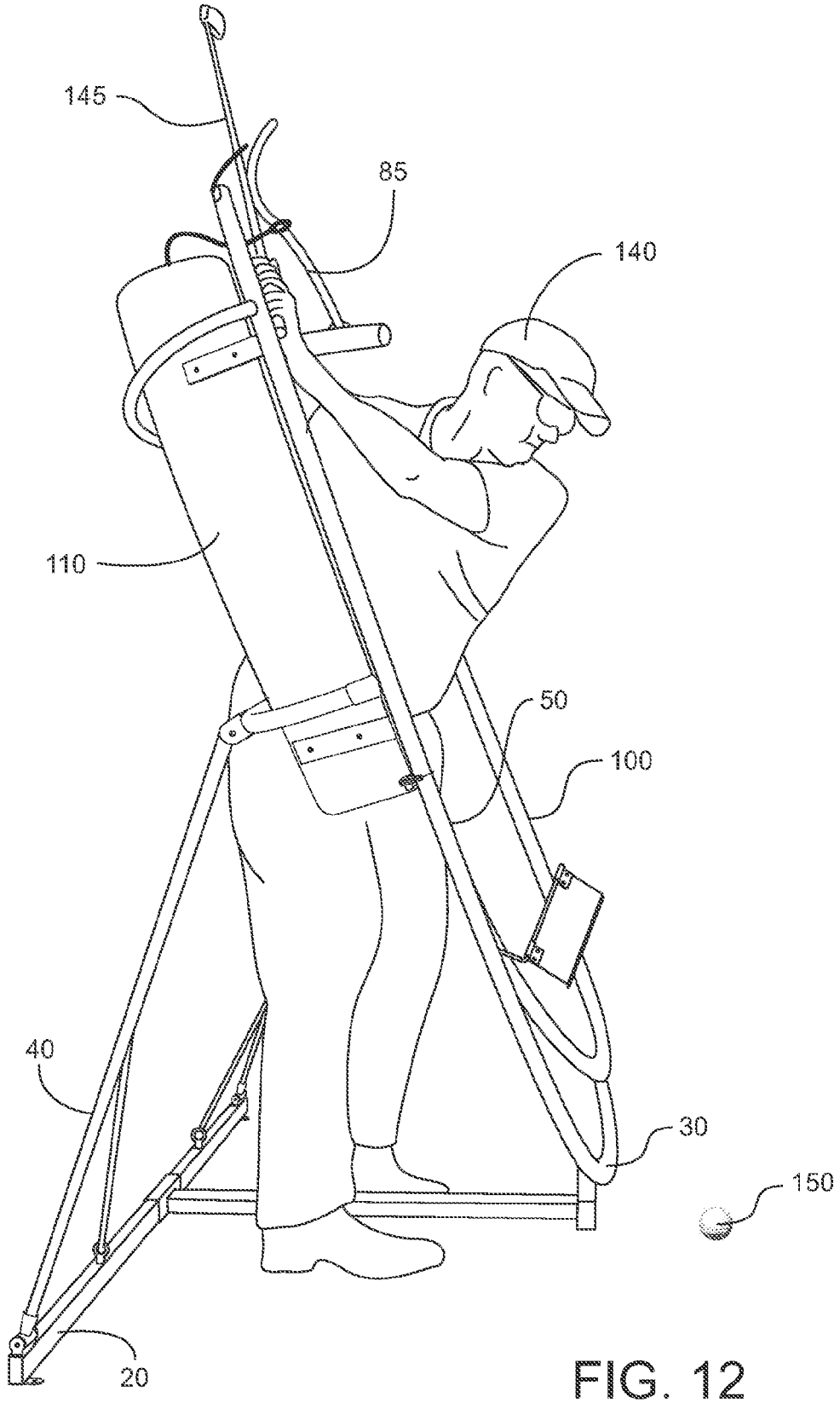
FIG. 12 illustrates a side view of one embodiment of the present invention in use.
Figure 13:
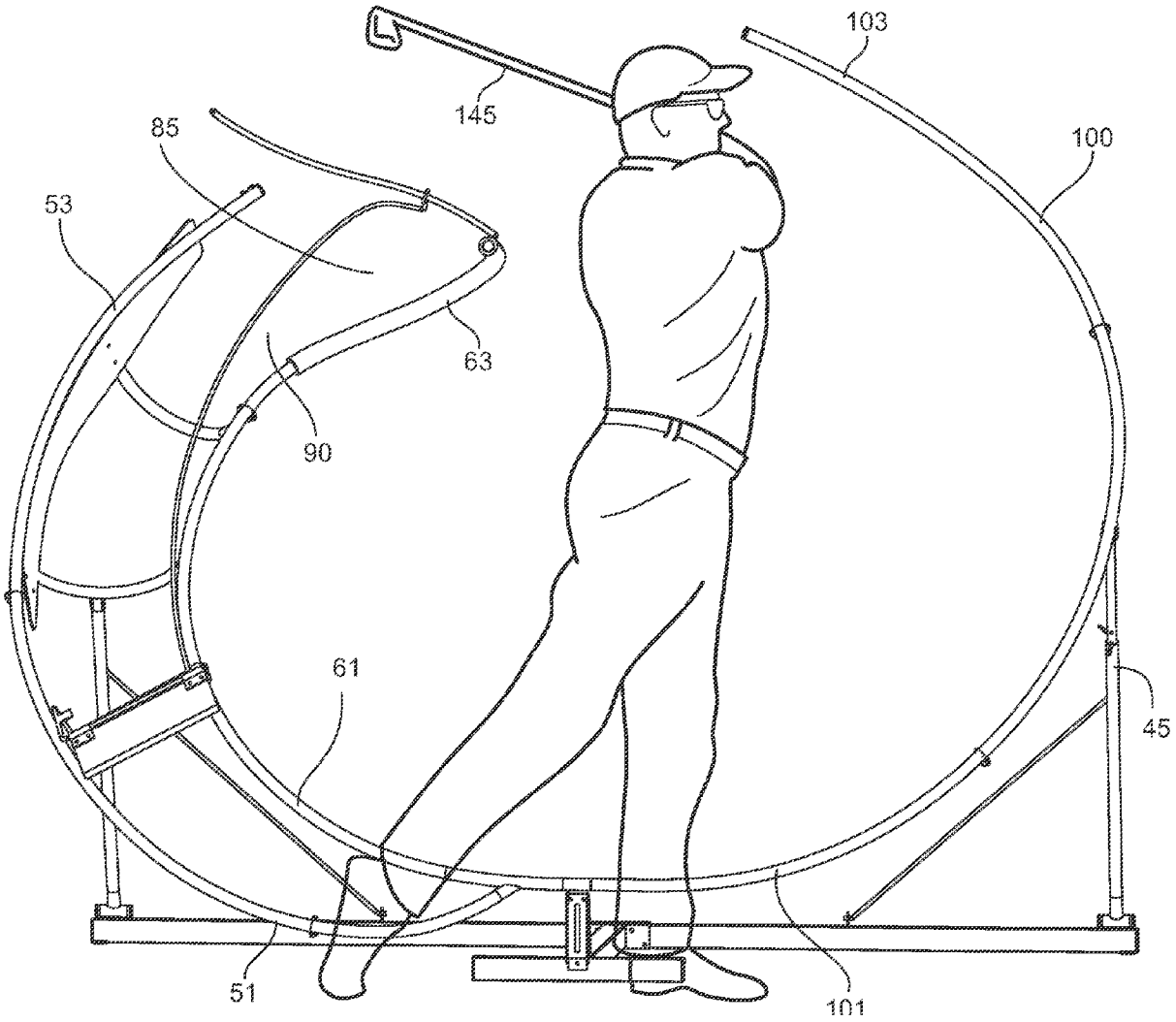
FIG. 13 illustrates a front view of one embodiment of the present invention in use.

The instant invention also includes a downswing guide rail 60 having a proximal end 61 and a distal end 63, in the form of an elongate, curved rail which facilitates the guiding of a golf club shaft 146 along a desired second angle and arc path from the top of the golfer's backswing, through and during a golfer's downswing and to a golfer's ball-striking position. As shown in the figures, the proximal end 61 of the downswing guide rail 60 is secured to the primary support member 35 and the distal end 63 of the downswing guide rail 60 extends at an angle above and behind the address area 142 further golfer 140 stands to address the golf ball 150. Looking to FIGS. 1, 4, 5 and 6, there is clearly illustrated in embodiment which demonstrates that the backswing guide rail 50 extends further out laterally and at a different angle and arc path than that of the downswing guide rail 60. In one embodiment of the instant invention, the downswing guide rail 60 is comprised of two or more pieces which are secured to one another using one or more fasteners.

The golf swing training aid 10 also includes a swing transition aid which is secured to the distal end 63 of the downswing guide rail 60 and an over-the-top button 80 which is hingedly secured to the distal end 53 of the backswing guide rail 50. The swing transition aid includes a spring transition gate 70 hingedly secured to the downswing guide rail 60, the transition gate 70 including an arm 76 with a proximal end 72 and a distal end 73 attached by a hinge 75. The swing transition aid also includes a resistance member 90 having a proximal end 92 secured to the downswing guide rail 60 and a distal end 94 with an engagement member 95 operationally associated with the transition gate 70. The over-the-top button 80 includes a hinge 81 and an arm 82. The area located between the distal portion 53 of the backswing guide rail and the distal portion 63 of the downswing guide rail and defined by the spring transition gate 70 and the over-the-top button defines the swing transition zone 85 which is the area in which a golfer reaches the top of his or her swing and transitions from the first angle and arc path to the second angle and arc path which is followed by the downswing and striking of a ball. Stated the different way, the swing transition aid operates to guide club from the top of a golfers backswing when the golf club is at the first angle to a second angle which is less steep than the first angle and the beginning of a downswing. In one embodiment of the instant invention, the over the top button 80 includes a spring biased hinge portion 81 and an arm portion lead to emanating away from the hinge portion 81 and extending into the swing transition zone 85 and allow a golf club 145 to move from the distal end 53 of the backswing guide rail 50, at the end of the desired first angle and arc path, into the swing transition zone 85, and the spring biased transition gate 70 includes a spring biased hinge portion 75 and an arm portion 76 emanating away from the hinge portion 75 and extending into the swing transition zone 85 and allow a golf club 145 to move from the swing transition zone 85 to the distal end 63 of the downswing guide rail 60 to guide the club 145 along the desired second angle and arc path to the golfer's ball-striking position.

The instant invention also includes a follow-through guide rail 100 with a proximal end 101 and a distal end 103. The follow-through guide rail 100 is secured at its proximal end 101 to the primary guard rail 30. The follow-through guide rail 100 curved rail which facilitates the guiding of a golf club shaft 146 along a third angle and arc path after reaching the golfer's 140 ball-striking position and completing the golf swing. In one embodiment of the instant invention, the follow-through guide rail 100 is comprised of two or more pieces which are secured to one another using one or more fasteners.

In one embodiment of the instant invention, each component is comprised of metal, plastic, wood, para-aramid synthetic fiber, carbon fiber, or a combination thereof. In another embodiment of the instant invention, the golf swing training aid 10 further includes one or more brace members 130 secured to the backswing guide rail 50 and the downswing guide rail 60 which aid in maintaining the distance and stability between the backswing guide rail 50 and the downswing guide rail 60. In still another embodiment, each brace members 130 may be individually adjusted to widen or narrow the distance between the backswing guide rail 50 and the downswing guide rail 60. Other embodiments of the instant invention may also include an anti-casting plate 110 secured to the backswing guide rail and extending back toward the primary base member to guide the golf club 145 along a swing path along a first angle and arc path inside that defined by the backswing guide rail 50. The curvature of the anti-casting plate 110 may be adjusted as necessary to define the desired swing path. The anti-casting plate 110 serves to encourage lateral rotation of the golfer's hips as he or she commences the downswing and to inhibit "casting" of the club at the start of the downswing. The primary function of the anti-casting plate is to ensure that the distance between the club head 148 and the golfer's core is decreased or compressed from the backswing to the downswing. Looking at the figures, the club shaft 146 rides along the backswing guide rail 50 and the club head 148 extends and travels outside the circumference of the backswing guide rail 50. The club shaft 146 and club head 148 then pass through the over the top button 80 in order to enter the swing transition zone 85 and engage the spring transition gate 70. The club shaft 146 engages the distal end 94 of the resistance member 90 at the end of the backswing and compression of the club head 148 distance begins. Compression continues as the golfer turns their hips forward, begins the downswing, maintaining contact with the resistance member 90 and bringing the club head 148 downward and inside the circumference of the backswing guide rail 50, inside the circumference defined by the anti-casting plate 110. If the golfer contacts the anti-casting plate 110 or the back-swing guide rail during the downswing, the golfer knows that they have failed to compress the distance between the club head 148 and the golfer's core during the transition from the backswing to the downswing and proper adjustment of swinging technique must be made. The downswing then continues until the club shaft 146 transitions contact from the resistance member 90 to the downswing guide rail 60, through the address position and up the follow-through guide rail 100 as the golfer completes their swing.

Other embodiments of the instant invention may also include a take-away flap 120 secured to the backswing guide rail 50 and extending forward toward the tertiary base member 31. The take-away flap 120 helps to define an area near the midway point and in front of the backswing guide rail 50 through which they golf club head 148 may pass during the backswing if a golfer has rotated the club head 148 clockwise to a desired angle in order to encourage hinging of the club during the backswing.

The instant invention may further include a shaft cover (not illustrated) which is designed to protect the shaft of a club 146 from any damage resulting from the shaft contacting and gliding the guide rails (or any other part) of the device. The instant invention is designed to allow a golf club to ride on the rails 30, 50, 60 and 100.

1. The club shaft 146 is in contact with the primary guide rail 30 when a user is addressing the ball 150
2. The club shaft 146 is in contact with the backswing guide rail 50 during the back swing
   a. The club head 148 is rotated from pointing forward at the address position to the toe pointing upward halfway through the back swing (i.e. 9 o'clock position)

b. The wrists are hinged and arms are lifted to complete the backswing
c. The backswing is completed along the first angle and arc path 3. The club shaft 146 contacts and passes through the over the top button 80 and is allowed to enter the swing transition zone 85
4. The club shaft 146 contacts the spring transition gate 70 and the resistance member 90, specifically the distal end 94 of the resistance member at the completion of the backswing
   a. The club 145 passes to the rear of the spring transition gate and the shaft contacts the resistance member 90 near the grip 147 of the golf club
   b. The resistance member 90 flexes back as the backswing is completed
   c. The transition from the first angle to the second angle begins
5. The club shaft 146 is in contact with the distal end 94 of the resistance member 90 and/or the downswing guide rail 60 during the start of the downswing
   a. Transitioning to contact with the downswing guide rail 60 at the proximal end 92 of the resistance member 90
   b. The golfer's hips move forward, compressing the distance between the club head 148 and the golfer's core and changing to the second angle and arc path
6. The release
   a. For a right handed golfer, the shaft 146 of the club travels from the 9 o'clock position with the right hand located behind the left, past the 6 o'clock position (address position) and to the 3 o'clock position with the left hand located behind the right hand and
      i. the club shaft 146 pointing at the target and
      ii. the toe of the club head 148 pointing upward
   b. The club shaft 146 contacts the primary guide rail 30 and transitions to the follow-through guide rail 100 and the angle shifts again to the third angle and arc path after reaching the golfer's ball striking position
7. The golfer's body rotates around with their chest facing the target
8. The shaft 146 comes off of the follow-through guide rail 100 and the golfer completes their swing with elbows bent and the club held above and extending across the golfer's back In one embodiment, the instant invention includes four phases of the swing taught by the device after addressing the ball:

Phase 1: Learn the 5 parts of the golf swing:
1. Wide backswing
2. Hinge wrists to the completion of the backswing
3. Hip rotation forward during the downswing
4. Release from the downswing, through the ball, and into the follow-through
5. Rotate the hips and body during the follow-through Phase 2: Smooth the swing process out so that it is all linked together in one fluid motion, like a proficient golfer Phase 3: Introduce a golf ball
1. Maintain the swing as learned in the previous steps
2. Make contact with the ball Phase 4: Hit the golf ball in full flow/swing The following grid contains the settings for the Height (H) on the primary support member 35 at the front of the base, Backswing setting (B) on the backswing guide rail 50 setting (by telescopically adjusting the proximal support member 40) and the Follow-through (F) on the follow-through guide rail 100 setting (by telescopically adjusting the distal support member 45). Settings can be adjusted to accommodate a user's height, swing style, injury and personal preference.

| | Height (User) | | | | | | | | |
|---|---|---|---|---|---|---|---|---|---|
| | 1.55 m | 1.6 m | 1.65 m | 1.7 m | 1.75 m | 1.8 m | 1.85 m | 1.9 m | 1.95 m |
| Device Height | H1 | H2 | H3 | H4 | H5 | H6 | H7 | H8 | H9 |
| Device Backswing | B1 | B2 | B3 | B4 | B5 | B6 | B7 | B8 | B9 |
| Device Follow-Through | F1 | F2 | F3 | F4 | F5 | F6 | F7 | F8 | F9 |

The instant invention functions on the principal that:
(1) a backswing has width, meaning that the distance from the club head 148 to a golfer's core is a wide distance; and
(2) a downswing has compression, meaning that the distance from the club head 148 to the golfer's core is about ½ as wide during the downswing as during the backswing.

The swing planes of the backswing and downswing are each different due to the above principals. The angle and arc path of the backswing is relatively upright and near vertical (the first angle and arc path). This is in contrast to the angle and arc path of the downswing which, due to the compression, flattens to a more horizontal angle (the second angle and arc path). The follow-through then completes the swing with another angle and arc path which result from the "release" of the club, the rotation of the golfer's body and bending of the elbows (the third angle and arc path). The first angle can vary anywhere between 44° and 86°. The second angle can vary anywhere between 30° to 65°. In one embodiment, the first angle is in the range of 49° and 82° and the second angle is in the range of 44° and 86°. In another embodiment, the first angle is in the range of 49° and 82° and the second angle is in the range of 34° and 60°. In another embodiment, the first angle is in the range of 54° and 86° and the second angle is in the range of 34° and 58°.

Another embodiment of the present invention discloses a portable golf swing training aid 10 comprising a base 20 including a primary base member 21, a secondary base member 26 secured to the primary base member and a tertiary base member 31 secured to the secondary base member 26. A primary support member 35 emanates upward from the tertiary base member 31 wherein the length of the primary support member 35 is adjustable to accommodate golfers of different heights and swing angles. A primary guide rail 30 is secured to the primary support member 35 and a backswing guide rail 50 is secured to the primary guide rail 30 in the form of an elongate, curved rail which facilitates the guiding of a golf club shaft 146 along a desired first angle and arc path from a golfer's address position within the address area 142 to the top of a golfer's backswing. A downswing guide rail 60 is secured to the primary guide rail 30 in the form of an elongate, curved rail which facilitates the guiding of a golf club 145 along a desired second angle and arc path from the top of a golfer's backswing to a golfer's ball-striking position. A swing transition aid is secured to a the downswing guide rail 60, the swing transition aid includes a swing transition gate 70 hingedly secured to the downswing guide rail 60, a resistance member 90 secured at one end to the downswing guide rail 60 and operationally associated with the swing transition gate 70 at an opposite end and an over the top button 80 hingedly secured to the backswing guide rail 50 wherein the swing transition aid operates to guide the golf club 145 from the top of a golfer's backswing when the golf club is at the first angle to a second angle which is less steep than the first angle and the beginning of a downswing. A follow-through guide rail 100 is secured to the primary guide rail 30 in the form of an elongate, curved rail which facilitates the guiding of a golf club shaft 146 along a third angle and arc path after reaching the golfer's ball-striking position and completing the golf swing. A proximal support member 40 with a proximal end 41 releaseably secured to the base 20 and a distal end 42 releaseably secured to the backswing guide rail 50 wherein the length of the proximal support member 40 is adjustable to accommodate golfers of different heights and swing angles and a distal support member 45 with a proximal end 46 releasably secured to the base 20 and a distal end 47 releaseably secured to the follow-through guide rail 100 wherein the length of the distal support member is adjustable to accommodate golfers of different heights and swing angles and one or more brace members 130 secured to the backswing guide rail 50 and the downswing guide rail 60 which aid in maintaining the distance between the backswing guide rail 50 and the downswing guide rail 60.

Any variation or embodiment contained herein may be applied to or included within the previous embodiment.

The instant invention also includes a method of using a portable golf swing training aid 10 comprising the steps of:

a) providing the portable golf swing training aid 10 comprising:

a base 20 including a primary base member 21, a secondary base member 26 secured to the primary base member 21 and a tertiary base member 31 secured to the secondary base member 26. The training aid 10 also includes a primary support member 35 emanating upward from the tertiary base member 31 and a primary guide rail 30 secured to the primary support member 35. A backswing guide rail 50 is secured to the primary guide rail 30 in the form of an elongate, curved rail which facilitates the guiding of a golf club shaft 146 along a desired first angle and arc path from a golfer's address position to the top of a golfer's backswing. A swing transition aid is secured to a downswing guide rail 60, the swing transition aid includes a spring transition gate 70 hingedly secured to the downswing guide rail 60, a resistance member 90 secured at one end to the downswing guide rail 60 and operationally associated with the spring transition gate 70 at an opposite end and an over the top button 80 hingedly secured to the backswing guide rail 50, wherein the swing transition aid operates to guide the golf club 145 from the top of a golfer's backswing when the golf club 145 is at the first angle to a second angle which is less steep than the first angle and the beginning of a downswing. The downswing guide rail 60 is secured to the primary guide rail 30 in the form of an elongate, curved rail which facilitates the guiding of a golf club 145 along the desired second angle and arc path from the top of a golfer's backswing to a golfer's ball-striking position. A proximal support member 40 secured at one end to the base 20 and secured at an opposite end to the backswing guide rail 50, a follow-through guide rail 100 is secured to the primary guide rail 30 in the form of an elongate, curved rail which facilitates the guiding of a golf club shaft 146 along a third angle and arc path after reaching the golfer's ball-striking position and completing the golf swing and a distal support member 45 secured at one end to the base 20 and secured at an opposite end to the follow-through guide rail 100;

b) placing a golfer 140 into an address area 142 wherein the golfer is holding a golf club 145 and addressing a golf ball 150 in preparation to hit the golf ball 150;

c) swinging the golf club 145 backward and upward along the backswing guide rail 50 along the desired first angle and arc path from the golfer's address position to the top of a golfer's backswing;

d) bringing the golf club 145 past the over the top button 80 and into the swing transition zone 85;

e) moving the golf club 145 through the swing transition zone a five to the second angle and to the downswing guide rail 60;

f) swinging the golf club 145 downward and forward along the desired second angle and arc path from the top of a golfer's backswing along the downswing guide rail 60 to a golfer's ball-striking position;

g) striking the golf ball 150;

h) swinging the golf club 145 forward and upward along the follow-through guide rail 100 along a third angle and arc path; and i) completing the golf swing.

The above method is repeated enough times in order to develop muscle memory and technique to achieve a reliable and optimum golf swing.

Any method described herein may incorporate any design element contained within this application and any other document/application incorporated by reference herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively discloses herein suitably may be practiced in the absence of any element which is not specifically disclosed herein.

The invention claimed is:

1. A portable golf swing training aid comprising:

a base including a primary base member, a secondary base member secured to the primary base member and a tertiary base member secured to the secondary base member;

a primary support member emanating upward from the tertiary base member;

a primary guide rail secured to the primary support member;

a backswing guide rail secured to the primary guide rail in the form of an elongate, curved rail which facilitates the guiding of a golf club shaft along a desired first angle and arc path from a golfer's address position to the top of a golfer's backswing;

a swing transition aid secured to a downswing guide rail, the swing transition aid includes:

a transition gate hingedly secured to the downswing guide rail;

a resistance member secured at one end to the downswing guide rail and operationally associated with the transition gate at an opposite end; and an over the top button hingedly secured to the backswing guide rail;

wherein the swing transition aid operates to guide the club from the top of a golfer's backswing when the golf club is at the first angle to a second angle which is less steep than the first angle and the beginning of a downswing;

the downswing guide rail secured to the primary guide rail in the form of an elongate, curved rail which facilitates the guiding of a golf club along the desired second angle and arc path from the top of a golfer's backswing to a golfer's ball-striking position;

a proximal support member secured at one end to the base and secured at an opposite end to the backswing guide rail;

a follow-through guide rail secured to the primary guide rail in the form of an elongate, curved rail which facilitates the guiding of a golf club shaft along a third angle and arc path after reaching the golfer's ball-striking position and completing the golf swing; and a distal support member secured at one end to the base and secured at an opposite end to the follow-through guide rail.

2. The portable golf swing training aid of claim 1 further comprising one or more brace members secured to the backswing guide rail and the downswing guide rail which aid in maintaining the distance between the backswing guide rail and the downswing guide rail.

3. The portable golf swing training aid of claim 2 wherein the proximal support member has a proximal end releaseably secured to the base and a distal end telescopically secured to a brace member and the distal support member has a proximal end releaseably secured to the base and a distal end telescopically secured to the follow-through guide rail.

4. The portable golf swing training aid of claim 1 wherein each component is comprised of metal, plastic, wood, para-aramid synthetic fiber, carbon fiber, or a combination thereof.

5. The portable golf swing training aid of claim 1 wherein:

the backswing guide rail is comprised of three or more pieces which are secured to one another using one or more fasteners;

the downswing guide rail is comprised of three or more pieces which are secured to one another using one or more fasteners; and the follow-through guide rail is comprised of three or more pieces which are secured to one another using one or more fasteners.

6. The portable golf swing training aid of claim 1 further comprising:

an anti-casting plate secured to the backswing guide rail and extending back toward the primary base member; and a take-away flap secured to the backswing guide rail and extending forward toward the tertiary base member.

7. The portable golf swing training aid of claim 1 wherein:

the over the top button includes a spring biased hinge portion and an arm portion emanating away from the hinge portion and extending into the swing transition zone and allow a golf club to move from the distal end of the backswing guide rail, at the end of the desired first angle and arc path, into the swing transition zone, and the spring biased transition gate includes a spring biased hinge portion and an arm portion emanating away from the hinge portion and extending into the swing transition zone and allow a golf club to move from the swing transition zone to the distal end of the downswing guide rail to guide the club along the desired second angle and arc path to the golfer's ball-striking position.

8. A method of using a portable golf swing training aid comprising the steps of:

providing the portable golf swing training aid comprising:

a base including a primary base member, a secondary base member secured to the primary base member and a tertiary base member secured to the secondary base member;

a primary support member emanating upward from the tertiary base member;

a primary guide rail secured to the primary support member;

a backswing guide rail secured to the primary guide rail in the form of an elongate, curved rail which facilitates the guiding of a golf club shaft along a desired first angle and arc path from a golfer's address position to the top of a golfer's backswing;

a swing transition aid secured to a downswing guide rail, the swing transition aid includes:

a transition gate hingedly secured to the downswing guide rail;

a resistance member secured at one end to the downswing guide rail and operationally associated with the transition gate at an opposite end; and an over the top button hingedly secured to the backswing guide rail;

wherein the swing transition aid operates to guide the club from the top of a golfer's backswing when the golf club is at the first angle to a second angle which is less steep than the first angle and the beginning of a downswing;

the downswing guide rail secured to the primary guide rail in the form of an elongate, curved rail which facilitates the guiding of a golf club along the desired second angle and arc path from the top of a golfer's backswing to a golfer's ball-striking position;

a proximal support member secured at one end to the base and secured at an opposite end to the backswing guide rail;

a follow-through guide rail secured to the primary guide rail in the form of an elongate, curved rail which facilitates the guiding of a golf club shaft along a third angle and arc path after reaching the golfer's ball-striking position and completing the golf swing; and a distal support member secured at one end to the base and secured at an opposite end to the follow-through guide rail;

placing a golfer into an address area wherein the golfer is holding a golf club and addressing a golf ball in preparation to hit the golf ball;

swinging the golf club backward and upward along the backswing guide rail along the desired first angle and arc path from the golfer's address position to the top of a golfer's backswing;

bringing the golf club past the over the top button and into the swing transition zone;

moving the golf club through the swing transition zone to the second angle and to the downswing guide rail;

swinging the golf club downward and forward along the desired second angle and arc path from the top of a golfer's backswing to a golfer's ball-striking position;

striking the golf ball;

swinging the golf club forward and upward along the follow-through guide rail along a third angle and arc path; and completing the golf swing.

9. The method of claim 8 further comprising one or more brace members secured to the backswing guide rail and the downswing guide rail which aid in maintaining the distance between the backswing guide rail and the downswing guide rail.

10. The method of claim 9 wherein the proximal support member has a proximal end releaseably secured to the base and a distal end telescopically secured to a brace member and the distal support member has a proximal end releaseably secured to the base and a distal end telescopically secured to the follow-through guide rail.

11. The method of claim 8 wherein each component is comprised of metal, plastic, wood, para-aramid synthetic fiber, carbon fiber, or a combination thereof.

12. The method of claim 8 wherein:

the backswing guide rail is comprised of three or more pieces which are secured to one another using one or more fasteners;

the downswing guide rail is comprised of three or more pieces which are secured to one another using one or more fasteners; and the follow-through guide rail is comprised of three or more pieces which are secured to one another using one or more fasteners.

13. The method of claim 8 further comprising:

an anti-casting plate secured to the backswing guide rail and extending back toward the primary base member; and a take-away flap secured to the backswing guide rail and extending forward toward the tertiary base member.

14. The method of claim 8 wherein:

the over the top button includes a spring biased hinge portion and an arm portion emanating away from the hinge portion and extending into the swing transition zone and allow a golf club to move from the distal end of the backswing guide rail, at the end of the desired first angle and arc path, into the swing transition zone, and the spring biased transition gate includes a spring biased hinge portion and an arm portion emanating away from the hinge portion and extending into the swing transition zone and allow a golf club to move from the swing transition zone to the distal end of the downswing guide rail to guide the club along the desired second angle and arc path to the golfer's ball-striking position.

15. A portable golf swing training aid comprising:

a base including a primary base member, a secondary base member secured to the primary base member and a tertiary base member secured to the secondary base member;

a primary support member emanating upward from the tertiary base member wherein the length of the primary support member is adjustable to accommodate golfers of different heights and swing angles a primary guide rail secured to the primary support member;

a backswing guide rail secured to the primary guide rail in the form of an elongate, curved rail which facilitates the guiding of a golf club shaft along a desired first angle and arc path from a golfer's address position to the top of a golfer's backswing;

a swing transition aid secured to a downswing guide rail, the swing transition aid includes:

a transition gate hingedly secured to the downswing guide rail;

a resistance member secured at one end to the downswing guide rail and operationally associated with the transition gate at an opposite end; and an over the top button hingedly secured to the backswing guide rail;

wherein the swing transition aid operates to guide the club from the top of a golfer's backswing when the golf club is at the first angle to a second angle which is less steep than the first angle and the beginning of a downswing;

the downswing guide rail secured to the primary guide rail in the form of an elongate, curved rail which facilitates the guiding of a golf club along the desired second angle and arc path from the top of a golfer's backswing to a golfer's ball-striking position;

a proximal support member with a proximal end releaseably secured to the base and a distal end releaseably secured to the backswing guide rail wherein the length of the proximal support member is adjustable to accommodate golfers of different heights and swing angles;

a follow-through guide rail secured to the primary guide rail in the form of an elongate, curved rail which facilitates the guiding of a golf club shaft along a third angle and arc path after reaching the golfer's ball-striking position and completing the golf swing;

a distal support member with a proximal end releasably secured to the base and a distal end releaseably secured to the follow-through guide rail wherein the length of the distal support member is adjustable to accommodate golfers of different heights and swing angles; and one or more brace members secured to the backswing guide rail and the downswing guide rail which aid in maintaining the distance between the backswing guide rail and the downswing guide rail.

16. The portable golf swing training aid of claim 15 wherein each component is comprised of metal, plastic, wood, para-aramid synthetic fiber, carbon fiber, or a combination thereof.

17. The portable golf swing training aid of claim 15 wherein:

the backswing guide rail is comprised of three or more pieces which are secured to one another using one or more fasteners;

the downswing guide rail is comprised of three or more pieces which are secured to one another using one or more fasteners; and the follow-through guide rail is comprised of three or more pieces which are secured to one another using one or more fasteners.

18. The portable golf swing training aid of claim 15 further comprising:

an anti-casting plate secured to the backswing guide rail and extending back toward the primary base member; and a take-away flap secured to the backswing guide rail and extending forward toward the tertiary base member.

19. The portable golf swing training aid of claim 15 wherein:

the over the top button includes a spring biased hinge portion and an arm portion emanating away from the hinge portion and extending into the swing transition zone and allow a golf club to move from the distal end of the backswing guide rail, at the end of the desired first angle and arc path, into the swing transition zone, and the spring biased transition gate includes a spring biased hinge portion and an arm portion emanating away from the hinge portion and extending into the swing transition zone and allow a golf club to move from the swing transition zone to the distal end of the downswing guide rail to guide the club along the desired second angle and arc path to the golfer's ball-striking position.

* * * * *